US006527243B1

(12) United States Patent
Kume, Jr.

(10) Patent No.: US 6,527,243 B1
(45) Date of Patent: Mar. 4, 2003

(54) FOLDING ARTICLE HOLDER

(76) Inventor: John M. Kume, Jr., 5937 Lake, Kingsville, OH (US) 44048

( * ) Notice: Subject to any disclaimer, the term of this patent is extended or adjusted under 35 U.S.C. 154(b) by 0 days.

(21) Appl. No.: 09/879,618

(22) Filed: Jun. 13, 2001

(51) Int. Cl.[7] ..... A47B 97/08

(52) U.S. Cl. ..... 248/448; 248/444; 248/447; 248/460; 108/168; 108/172

(58) Field of Search ..... 248/441.1, 444, 248/447, 448, 460, 346.07, 346.3; 108/166, 167, 171, 168, 172, 115; 52/716.1, 716.6, 716.7, 716.8, 782.23, 782.21, 796.11; 40/661.06, 661.07

(56) References Cited

U.S. PATENT DOCUMENTS

| | | | | | |
|---|---|---|---|---|---|
| 4,312,507 | A | | 1/1982 | Smith et al. | 273/237 |
| 4,359,004 | A | * | 11/1982 | Chappell | 108/166 |
| 4,852,499 | A | * | 8/1989 | Ozols | 108/166 |
| 4,875,688 | A | | 10/1989 | Whaley | 273/285 |
| 5,150,873 | A | * | 9/1992 | Donovan | 248/441.1 |
| 5,348,263 | A | * | 9/1994 | Hubbard | 248/444 |
| 5,388,838 | A | | 2/1995 | Bohrer | 273/285 |
| 5,427,033 | A | * | 6/1995 | Bly | 108/44 |
| 5,597,256 | A | * | 1/1997 | Burton et al. | 402/4 |
| 5,655,651 | A | * | 8/1997 | Maier | 206/1.7 |
| 5,868,389 | A | | 2/1999 | Kalivas | 273/286 |
| 6,128,842 | A | * | 10/2000 | Lotspeich et al. | 40/611 |
| 6,220,598 | B1 | | 4/2001 | Kweitko et al. | 273/309 |
| 6,233,858 | B1 | * | 5/2001 | Brach, Jr. et al. | 40/660 |
| 6,234,701 | B1 | | 5/2001 | Karten et al. | 402/73 |

* cited by examiner

*Primary Examiner*—Leslie A. Braun
*Assistant Examiner*—Deborah M. Brann
(74) *Attorney, Agent, or Firm*—Forrest L. Collins

(57) ABSTRACT

The present invention describes a foldable device useful for supporting an article, such as a book. The foldable device may be unfolded to a convenient size and locked into a firm position to support an article such as a book. When not in use the foldable device is folded to approximately half of its unfolded dimension.

12 Claims, 1 Drawing Sheet

104
124
118

18
16

112
110
18

10
16
50
46
22
24
26
100
40
3
3
18
54
30
52
48
46
44
20
32
200
54
28
56
34

H
16
10
64
60
200
100
52
82
80
18
W
28
68
40
30

FOLDING ARTICLE HOLDER

BACKGROUND OF THE INVENTION

1. Field of the Invention

The present invention relates to a compact foldable article useful for supporting a second article, such as a book.

2. Description of the Art Practices

U.S. Pat. No. 5,868,389 issued to Kalivas Feb. 9, 1999 describes a portable game board. The portable game board of Kalivas is stated to be made of a fabric sheet, printed with the game board design, and hemmed at two opposing edges. Two dowels are inserted through the hems. A pair of frame rails include pivotably mounted legs. Holes are provided in the frame rails for insertion of the dowels and for spreading the dowels approximately the length of the fabric sheet. The legs are pivotally mounted to frame rails by pins for storing the legs in a linear relationship with the frame rails, and for deploying the legs in a support attitude against the dowels.

In U.S. Pat. No. 5,388,838 issued to Bohrer on Feb. 14, 1995 there is described a collapsible stiff game board. The game board of Bohrer is stated to be inexpensive, easy to manufacture, stiff, two-axis collapsible, repeatably/markable/erasable, lightweight game board. The game board of Bohre is comprised of segments loosely attached to one or more fasteners. Upon expansion the segments of the collapsible stiff game board interlock and maintain the game board shape.

Whaley describes a convertible game carrying case in U.S. Pat. No. 4,875,688. The Whaley patent issued Oct. 24, 1989. The Whaley patent further describes the convertible game carrying case as convertible to a game board including two identical half sections, symmetrical in construction and doweling. The two sections can be adapted to house the playing pieces in the carrying case configuration. The sections can also be oriented so that when section one and section two are connected end-to-end, they provide the playing surface. Dowel pins are affixed to section one. Dowel holes on the second section are adapted to frictionally receive the dowel pins for both the carrying case and the game board configurations.

A portable lighted study or game tray is described in U.S. Pat. No. 4,312,507 issued Jan. 26, 1982 to Smith, et al. The Smith, et al., patent describes a portable tray for use in various activities such as study or games is disclosed. The tray includes an accessory bag located beneath the center portion of the tray, with a hinged cover which folds flat with the main portion of the base. Hinged legs are provided on the under side of the tray to provide support during use. The sides of the base are curved outwardly toward the user to increase the adjacent usable tray surface. A detachable light is conveniently mounted on the rear of the tray.

U.S. Pat. No. 6,220,598 issued to Kweitko, et al., on Apr. 24, 2001 describes a protective skirt disposed on the surface of a gaming table of the type having a player area and a dealer area. The gaming table additionally includes a rail covering the margin of the gaming table proximate the player area. The skirt includes an inner edge, which may be optionally tapered, and an outer edge disposed proximate the rail such that the skirt extends onto the gaming table surface to overlay at least a portion of the player area of the gaming table. Optionally, the outer edge of the Kweitko, et al., device has a shape to substantially conform to the shape of the gaming table. Thus, for a gaming table that is arcuate, the outer edge is substantially arcuate. In an optional embodiment, the skirt may be fixed by securing the outer edge between the rail and the gaming table.

A molded plastic binder is described in Karten's et al., U.S. Pat. No. 6,234,701 issued May 22, 2001. The Karten's et al., patent describes a binder formed of two cover portions made of rigid material joined together with a living hinge is disclosed. A closure flap with a second living hinge joins the free ends of the cover opposite the binder spine. An improved method of attaching a pocket to the binder is also disclosed. The use of such a technique on rigid polypropylene material allows roll feeding of materials, eliminates the need for a chipboard, allows existing printing and sealing machinery to be employed in the manufacture of the binder, and provides improved durability and aesthetics at a low cost. One cover portion may be adapted with number design features to properly align one cover portion relative to the other cover portion. A pocket formed of rigid material may also be coupled to one of the cover portions.

To the extent that the foregoing patents and citations are relevant to the present invention they are herein incorporated by reference.

SUMMARY OF THE INVENTION

The present invention describes a folding article holder comprising:

- a first supporting segment, for when in use, supporting at least a portion of an article,
- a second supporting segment, for when in use, supporting at least a portion of the article;
- a connecting region connecting said first supporting segment to said second supporting segment; and
- at least one slidable frame piece having a length, a width, and a height, for when in use, engaging said first supporting segment and said second supporting segment in a fixed position.

The present invention further describes a folding article holder comprising:

- a first supporting segment having a lengthwise dimension, heightwise dimension, and a widthwise dimension, for when in use, supporting at least a portion of an article;
- said first supporting segment having a upper region and a lower region and further having an obverse side and a reverse side, and extending partially along the said widthwise dimension of said first supporting segment is at least one first supporting segment rib,
- a second supporting segment having a lengthwise dimension, heightwise dimension, and a widthwise dimension, for when in use, supporting at least a portion of an article;
- said second supporting segment having a upper region and a lower region and further having an obverse side and a reverse side, and extending partially along the said widthwise dimension of said second supporting segment is at least one second rib;
- a connecting region for, when in use, flexibly connecting said first supporting segment to said second supporting segment;
- a first slidable generally T-shaped frame piece having a base region, two side legs, and a void extending between the said two side legs;
- said first slidable generally T-shaped frame piece having at least one lengthwise channel extending along the interior length of the said base region, for when in use, engaging the said first supporting segment rib, a second slidable generally T-shaped frame piece having a base region, two side legs, and a void extending between the said two side legs; and said second slidable generally T-shaped frame piece having at least one lengthwise channel extending along the interior length of the said base region, for when in use, engaging the said second rib supporting segment rib.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE INVENTION

Figures 1, 2, 3, 4, 5:
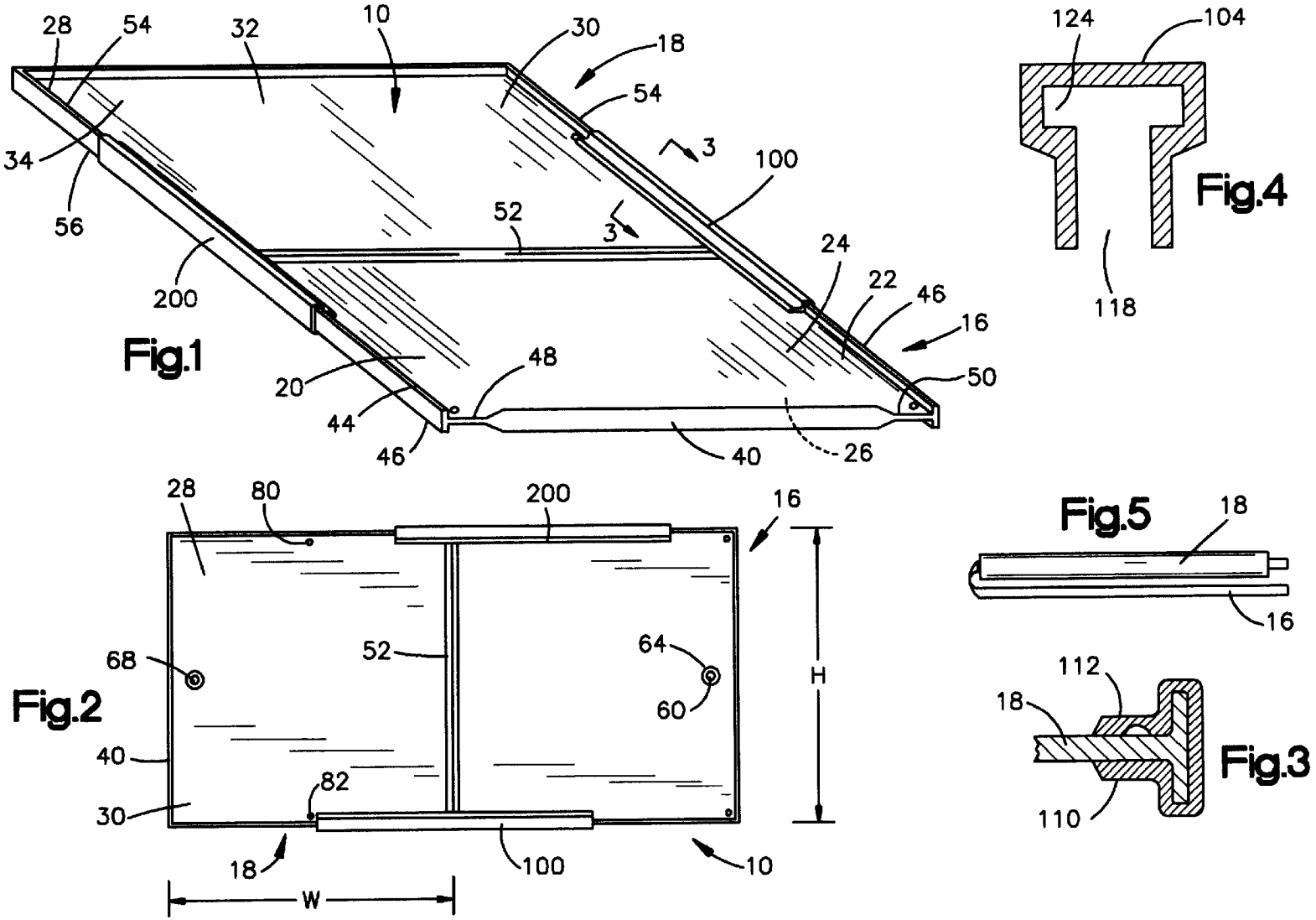
FIG. 1 is a frontal perspective of a finished product embodiment according to the invention.
FIG. 2 is a plan view of a finished product embodiment according to the invention.
FIG. 3 is a partial sectional view taken along line 3—3 of FIG. 1.
FIG. 4 is a partial sectional view taken along line 3—3 of FIG. 1 with an interconnecting piece removed; and, FIG. 5 is a perspective of the device of FIG. 1 in a closed folded position.

As best seen in FIG. 1 is a folding article holder 10 according to the present invention. The folding article holder 10 is generally similar to a conventional paper holder or trapper keeper.

The folding article holder 10 has a first supporting segment 16 and a second supporting segment 18. The first supporting segment 16 and the second supporting segment 18 are conveniently manufactured from a plastic such as polycarbonate or from cardboard covered with polyvinyl chloride.

The first supporting segment 16 is generally symmetrical in that the upper region 20 and the lower region 22 of the first supporting segment 16 are identical. The first supporting segment 16 is generally symmetrical in that the obverse side 24 of the first supporting segment 16 and the reverse side 26 of the first supporting segment 16 are also identical.

The second supporting segment 18 is conveniently manufactured to be identical in symmetry to the first supporting segment 16. The identical nature of the first supporting segment 16 and second supporting segment 18 greatly aid in the manufacture of the folding article holder 10 and reduce the cost of the folding article holder 10.

The second supporting segment 18 has an upper region 28 and the lower region 30. The second supporting segment 18 has an obverse side 32 and the reverse side 34.

It is noted, however, that the first supporting segment 16 and the second supporting segment 18 need not be identical. For instance, the folding article holder 10 may have a mechanism for holding loose papers (not shown). The folding article holder 10 may have a means for retaining a pad of paper on one side (the first supporting segment 16) and not the other side (the second supporting segment 18).

The first supporting segment 16 has a flange 40 substantially located on one side of its perimeter. The remaining two external sides of the perimeter of the first supporting segment 16 are defined by the upper region 20 and lower region 22. The upper region 20 of the first supporting segment 16 has an upper rib 44. The lower region 22 of the first supporting segment 16 has a lower rib 46. The upper rib 44 and the lower rib 46 are parallel to one another.

A first recessed area 48 and a second recessed area 50 are located on the flange 40 on the one exterior side near the upper region 20 and lower region 22 of the first supporting segment 16 respectively. The first recessed area 48 and the second recessed area 50 are such that the flange 40 does not extend to the upper rib 44 and a lower rib 46.

The first supporting segment 16 and the second supporting segment 18 are joined edge to edge by a hinge mechanism 52. The hinge mechanism 52 is utilized to permit the first supporting segment 16 and the second supporting segment 18 to move relative to one another. The hinge mechanism 52 permits the folding of one of the first supporting segment 16 on top of the second supporting segment 18. The hinge mechanism 52 is, for the sake of completeness, the fourth side of the first supporting segment 16.

Conveniently, the first supporting segment 16 and the second supporting segment 18 are joined by means of a living hinge mechanism 52. The use of the living hinge 52 permits the construction of the folding article holder 10 as a single piece.

The second supporting segment 18 has an upper rib 54 and a lower rib 56 located in the corresponding regions defined by the upper region 20 and lower region 22 of the first supporting segment 16. The upper rib 54 and the lower rib 56 are parallel to one another.

A fastening mechanism 60, as shown in FIG. 2, is utilized to permit a fixed folded closure of the first supporting segment 16 and the second supporting segment 18. The fastening mechanism 60 is centrally located along the heightwise dimension H of the on the first supporting segment 16 is the fastening mechanism first part 64.

On the second supporting segment 18 there is located the fastening mechanism second part 68. The fastening mechanism 60 of choice is Velcro (utilizing a hook 64 and eye mechanism 68). In practice, virtually any fastening mechanism may be employed. For example, a hook closure may be utilized.

A raised stop button 80 is located in the upper region 28 of the second supporting segment 18. The raised stop button 80 projects upward from the obverse side 32 of the second supporting segment 18. That is, the raised stop button 80 rises above the plane of the second supporting segment 18.

A second raised stop button 82 is located near the lower region 30 of the second supporting segment 18. The second raised stop button 82 projects upward from the obverse side 32 of the second supporting segment 18. The second raised stop button 82 is located approximately at a point one half of the width W of the second supporting segment 18.

A first slidable frame piece 100 is shown in FIG. 1. The slidable frame piece 100 is conveniently manufactured from a relatively rigid plastic such as polyvinyl chloride. The first slidable frame piece 100 may be extruded and cut into appropriate lengths. The length of the slidable frame piece should be slightly less than the width of the supporting segment 16 (and accordingly the width of the supporting segment 18).

As best seen in FIG. 3 is a sectional view of the first slidable frame piece 100 taken along lines 3—3 of FIG. 1. The first slidable frame piece 100 is generally T-shaped and has a base 104, a leg 110, and a leg 112.

As is shown in FIG. 4, the base 104 at least partially defines a centrally located void 118. The centrally located void 118 extends along the length of the base of the first slidable frame piece 100.

The leg 110 and the leg 112 each extend from the base of the first slidable frame piece 100. The leg 110 and the leg 112 at least partially define a centrally located channel 124. The void 124 communicates with the centrally located channel 118 in the first slidable frame piece 100. The slidable frame piece 100 is utilized to retain the first supporting segment 16 and the second supporting segment 18 in a locked position. Thus, the interior dimensions of the void 124 are conveniently smaller than the upper rib 44 and a lower rib 46.

The folding article holder 10 is assembled by inserting the first slidable frame piece 100 over the upper rib 44 and the lower rib 46 of the first supporting segment 16. The upper rib 44 engages the void 124. The centrally located channel 118 provides engages the obverse side 24 of the first supporting segment 16 and the reverse side 26 of the first supporting segment 16.

The first slidable frame piece 100 thus engages the upper rib 44 and the lower rib 46 of the first supporting segment 16 and is snuggly seated in the base 104. The first slidable frame piece 100 fills the void 124 in the base 104. In this manner the first slidable frame piece 100 is secured to the folding article holder 10.

In use the folding article holder 10 will normally be in a closed position as best seen in FIG. 5. When a user of the folding article holder 10 desires to place an article thereon, the user will unfold the folding article holder 10 such that the first supporting segment 16 and the second supporting segment 18 are in the same plane.

The first slidable frame piece 100 is slid from its first position, as seen in FIG. 2, along the upper rib 44 and the lower rib 46 of the first supporting segment 16 and across the living hinge 52. The movement of the first slidable frame piece 100 is continued onto the upper rib 54 and the lower rib 56 of the second supporting segment 18.

The user will continue to slide the first slidable frame piece 100 along the upper rib 54 and the lower rib 56 of the second supporting segment 18 until the first slidable frame engages the first stop button 82 located on the second supporting segment 18.

The folding article holder 10 is fully functional by utilizing the single first slidable frame piece 100. However, to ensure that the folding article holder 10 is easily utilized the second slidable frame piece 200 is included in the construction. The second slidable frame piece 200 is attached to the first supporting segment 18 at the opposite end from the first slidable frame piece 100.

A second slidable frame piece 200 may also be provided. The construction and dimensions of the second slidable frame piece 200 are identical to the first slidable frame piece 100.

When the folding article holder 10 is equipped with a second slidable frame piece 200 the method of operation to engage the second slidable frame piece 200 on the first supporting segment 16 is similar to that for engaging the first slidable frame piece 100 on the first supporting segment 16. In use, the second slidable frame piece 200 is similarly positioned up to the second stop button 82 on the second supporting segment 18.

In the foregoing manner, one desiring to use the present invention effectively obtains a tabletop that may be spread out on the lap. A book or other article may be conveniently laid on the tabletop. The invention is particularly useful for males who do not have the same ability as females to use the legs as a lap.

What is claimed is:

1. A folding article holder comprising:

a first supporting segment, for when in use, supporting at least a portion of an article;

a second supporting segment, for when in use, supporting at least a portion of the article;

a connecting region connecting said first supporting segment to said second supporting segment; and at least one slidable frame piece having a length, a width, and a height, for when in use, engaging said first supporting segment and said second supporting segment in a fixed position, provided further that the at least one slidable frame piece has a smaller lengthwise dimension than the widthwise dimension of the said first supporting segment.

2. The folding article holder according to claim 1, wherein said first supporting segment has a lengthwise dimension, heightwise dimension, and a widthwise dimension, and the said at least one slidable frame piece is, when in use, slidable along at least a portion of said widthwise dimension of said first supporting segment.

3. The folding article holder according to claim 1, wherein said connecting region is a living hinge.

4. The folding article holder according to claim 1, wherein the said first supporting segment has an obverse side and a reverse side, and that located on the obverse side of the said first supporting segment along the said widthwise dimension of said first supporting segment is at least one first supporting segment rib.

5. The folding article holder according to claim 4, wherein said first supporting segment rib extends partially along the said widthwise dimension of said first supporting segment.

6. The folding article holder according to claim 4, wherein at least one second supporting segment rib extends along said reverse side of the said widthwise dimension of the said first supporting segment opposite said first supporting segment rib.

7. The folding article holder according to claim 4, wherein said first supporting segment has a upper region and a lower region, and said at least one first supporting segment rib is located in said upper region, and at least one second supporting segment rib is located in said upper region of the said widthwise dimension of the said first supporting segment.

8. The folding article holder according to claim 4, wherein the said at least one slidable frame piece is widthwise generally T-shaped having a base region and two side legs, and a void extending between the said two side legs.

9. The folding article holder according to claim 8, wherein the at least one generally T-shaped slidable frame piece has extending along the interior length of the said base region at least one lengthwise slidable frame piece channel, said lengthwise slidable frame piece channel, for when in use, receiving said first supporting segment rib.

10. A folding article holder comprising:

a first supporting segment having a lengthwise dimension, heightwise dimension, and a widthwise dimension, for when in use, supporting at least a portion of an article;

said first supporting segment having a upper region and a lower region and further having an obverse side and a reverse side, and extending partially along the said widthwise dimension of said first supporting segment is at least one first supporting segment rib;

a second supporting segment having a lengthwise dimension, heightwise dimension, and a widthwise dimension, for when in use, supporting at least a portion of an article;

said second supporting segment having a upper region and a lower region and further having an obverse side and a reverse side, and extending partially along the said widthwise dimension of said second supporting segment is at least one second supporting segment rib;

a connecting region for, when in use, flexibly connecting said first supporting segment to said second supporting segment;

a first slidable generally T-shaped frame piece having a base region, two side legs, and a void extending between the said two side legs;

said first slidable generally T-shaped frame piece having at least one lengthwise channel extending along the interior length of the said base region, for when in use, engaging the said first supporting segment rib, a second slidable generally T-shaped frame piece having a base region, two side legs, and a void extending between the said two side legs; and said second slidable generally T-shaped frame piece having at least one lengthwise channel extending along the interior length of the said base region, for when in use, engaging the said second supporting segment rib, said first and second supporting segments further having a stop member to limit the sliding motion of said first and second slidable generally T-shaped frame pieces along said first and second supporting segment rib.

11. The folding article holder according to claim 10, wherein the said first slidable generally T-shaped frame piece is associated with the said lower region of the said first supporting segment and said second slidable generally T-shaped frame piece is associated with the said upper region of the said first supporting segment.

12. The folding article holder according to claim 11, wherein said connecting region is a living hinge.

* * * * *

UNITED STATES PATENT AND TRADEMARK OFFICE

CERTIFICATE OF CORRECTION

PATENT NO. : 6,527,243 B1
DATED : March 4, 2003
INVENTOR(S) : John M. Kume, Jr.

It is certified that error appears in the above-identified patent and that said Letters Patent is hereby corrected as shown below:

Column 6,
Line 2, Claim 1 should read: 1. A folding article holder comprising:

a first supporting segment, for when in use, supporting at least a portion of an article;
a second supporting segment, for when in use, supporting at least a portion of the article;
a connecting region connecting said first supporting segment to said second supporting segment; and
at least one slidable frame piece having a length, a width, and a height, for when in use, engaging said first supporting segment and said second supporting segment in a fixed position, provided further that the at least one slidable frame piece has a smaller lengthwise dimension than the widthwise dimension of the said first supporting segment, said first and second supporting segments further having a stop member to limit the sliding motion of said at least one slidable frame piece along first and second supporting segment ribs extending along the widthwise dimension of said first and second supporting segments.

Signed and Sealed this

Eighth Day of June, 2004

JON W. DUDAS
*Acting Director of the United States Patent and Trademark Office*